US009376788B1

(12) United States Patent
Turner

(10) Patent No.: US 9,376,788 B1
(45) Date of Patent: Jun. 28, 2016

(54) WATER COLLECTION APPARATUS

(71) Applicant: James H. Turner, Campbell, CA (US)

(72) Inventor: James H. Turner, Campbell, CA (US)

( * ) Notice: Subject to any disclaimer, the term of this patent is extended or adjusted under 35 U.S.C. 154(b) by 0 days.

(21) Appl. No.: 14/793,458

(22) Filed: Jul. 7, 2015

Related U.S. Application Data

(63) Continuation of application No. 14/741,364, filed on Jun. 16, 2015.

(51) Int. Cl.
*E03B 1/04* (2006.01)
*A47K 3/28* (2006.01)

(52) U.S. Cl.
CPC ..... *E03B 1/042* (2013.01); *A47K 3/281* (2013.01); *E03B 2001/045* (2013.01)

(58) Field of Classification Search
CPC ..... F25D 23/06; F25D 23/066
USPC ..... 4/597
See application file for complete search history.

(56) References Cited

U.S. PATENT DOCUMENTS 3,035,275 A * 5/1962 Strebeigh ..... A47K 3/38 160/237
3,080,568 A 3/1963 Burnett
3,380,081 A * 4/1968 Eilertson ..... A47K 1/14 137/454.2
3,639,919 A 2/1972 White
4,115,879 A * 9/1978 Toms ..... E03B 1/04 210/138
4,202,061 A * 5/1980 Waters ..... B64C 1/1453 137/805
4,224,700 A 9/1980 Bloys
4,357,719 A * 11/1982 Badger ..... B64D 11/02 210/767
4,893,364 A 1/1990 Keeler
4,975,992 A 12/1990 Patterson et al.
5,140,714 A 8/1992 Horenstein et al.
5,165,456 A 11/1992 Woolman
5,168,586 A 12/1992 Small
5,192,426 A 3/1993 DeCoster et al.
5,210,886 A 5/1993 Coe, III
5,217,323 A 6/1993 Bilson
5,265,287 A 11/1993 Henkin et al.
5,274,861 A 1/1994 Ford
5,341,529 A 8/1994 Serrano
5,353,448 A 10/1994 Lee
5,465,434 A 11/1995 Coe (Continued)

FOREIGN PATENT DOCUMENTS

WO 9954559 A1 10/1999
WO 2008134839 A2 11/2008

(Continued)

*Primary Examiner* — Arthur O Hall
*Assistant Examiner* — Chee-Chong Lee
(74) *Attorney, Agent, or Firm* — Jocabsen IP Law; Krista S. Jacobsen

(57) ABSTRACT

Disclosed herein are apparatuses for collecting water in a shower or bathtub enclosure. The apparatus comprises a water-resistant or waterproof panel, one or more connectors coupled or coupleable to the panel, the one or more connectors enabling the panel to be disposed within the shower or bathtub enclosure, and a receptacle coupled or coupleable to the panel, the receptacle having an opening for collecting water from a surface of the panel, the receptacle for delivering the collected water to a destination other than a drain of the shower or bathtub enclosure. The destination may be a container, a bucket, a toilet, a tank, a planter box, a plant pot, or an outdoor location such as a garden or lawn. The collected water may flow directly to the destination, or the apparatus may use a channel to deliver the collected water to the destination.

20 Claims, 6 Drawing Sheets

(56) References Cited

U.S. PATENT DOCUMENTS

| | | | | |
|---|---|---|---|---|
| 5,790,992 | A | 8/1998 | Ray | |
| 5,862,544 | A | 1/1999 | Placencia | |
| 5,980,756 | A * | 11/1999 | Tracy | B64D 11/02 210/744 |
| 6,082,799 | A * | 7/2000 | Marek | A61G 3/001 296/19 |
| 6,132,138 | A | 10/2000 | Haese | |
| 6,178,571 | B1 | 1/2001 | McAllister | |
| 6,328,882 | B1 | 12/2001 | Rosenblatt | |
| 6,581,218 | B1 | 6/2003 | Koepenick, III | |
| 6,591,432 | B1 | 7/2003 | Feinstein et al. | |
| 6,887,375 | B2 | 5/2005 | Johnson | |
| 7,047,577 | B1 | 5/2006 | Cirilli | |
| 7,328,466 | B1 * | 2/2008 | Bowen | A47K 3/302 160/23.1 |
| 7,490,373 | B1 | 2/2009 | Zavala-Avelar | |
| 7,854,852 | B1 | 12/2010 | Reavis | |
| 9,000,000 | B2 | 4/2015 | Carroll | |
| 2004/0168992 | A1 * | 9/2004 | Ben-Amotz | E03B 1/04 210/805 |
| 2005/0098638 | A1 | 5/2005 | Hanna | |
| 2007/0130684 | A1 * | 6/2007 | Watts | B60R 15/02 4/596 |
| 2007/0199875 | A1 * | 8/2007 | Moorey | B01D 61/147 210/206 |
| 2008/0083064 | A1 | 4/2008 | Litwhiler | |
| 2009/0165875 | A1 | 7/2009 | Winn | |
| 2009/0173388 | A1 | 7/2009 | Sever | |
| 2009/0212051 | A1 | 8/2009 | Liu | |
| 2010/0043129 | A1 | 2/2010 | Platteel et al. | |
| 2010/0051107 | A1 | 3/2010 | Crawford | |
| 2010/0193049 | A1 | 8/2010 | Bondura | |
| 2011/0088162 | A1 | 4/2011 | Nellesen | |
| 2012/0167298 | A1 | 7/2012 | Litwhiler | |
| 2013/0025686 | A1 | 1/2013 | Norton | |
| 2013/0212800 | A1 | 8/2013 | Kaler et al. | |

FOREIGN PATENT DOCUMENTS

| | | | |
|---|---|---|---|
| WO | 2008144806 | A1 | 12/2008 |
| WO | 2010109156 | A2 | 9/2010 |
| WO | 2012001683 | A2 | 1/2012 |

* cited by examiner

WATER COLLECTION APPARATUS

CROSS REFERENCE TO RELATED APPLICATIONS

This application is a continuation of U.S. patent application Ser. No. 14/741,364, filed Jun. 16, 2015 and entitled "Water Collection Apparatus," which is hereby incorporated by reference in its entirety for all purposes.

BACKGROUND

Numerous water conservation methods and apparatuses have been devised for conserving household water. Shower heads having a limited flow rate are required by law in some jurisdictions, as are other mandatory temporary or permanent water conservation methods and devices, such as restrictions on outside watering and low-flow toilets. Some methods and devices for household water conservation focus on collecting so-called "grey water" from, for example, bathroom sinks, showers, tubs, and washing machines. The grey water may contain traces of dirt, food, grease, hair, and household cleaning products and therefore is not potable, but it may be used, for example, in toilet tanks or to water plants.

Some water conservation methods and apparatuses collect cold or lukewarm potable water that would otherwise be wasted while a person wishing to take a shower waits for the water flowing out of the showerhead to reach an acceptable temperature for showering. For example, U.S. Patent Publication No. 2010/0051107 by Crawford discloses using a bucket to collect water from a showerhead while the person taking the shower waits for the water to reach the desired temperature. A lid with a spout attaches to the bucket to enable the watering of household or landscape plants using the collected water. A disadvantage of this approach is that if the bucket is placed on the floor of the shower, most of the water from the showerhead misses the bucket because the showerhead disperses the water over an area that extends beyond the open portion of the bucket. Although some people may have sufficient height and strength to hold the bucket near the showerhead while waiting for the water temperature to reach a desired level, thereby capturing more water than if the bucket were on the floor, it may be difficult or impossible for some people (e.g., children or elderly people) to hold the bucket close to the shower head as water fills the bucket.

U.S. Pat. No. 5,165,456 to Woolman discloses a diverter apparatus and method for saving potable water from being wasted while a shower user waits for usable hot water to discharge from a shower fixture or from a faucet fixture. The apparatus comprises a two-way diverter valve having an inlet port and two outlet ports. The inlet port is attached to the shower fixture to divert the fresh water to one of the outlet ports, which is connected to one end of a hose. The hose connects the diverter valve and a storage container so that the initial cold water passes through the hose to the container until hot water is discharged. The other outlet port of the diverter valve allows water to flow through the showerhead. One disadvantage of this approach is that the user must install the diverter valve, which may be inconvenient because it requires the user to remove the showerhead. Another disadvantage is that because the diverter valve directs the water through a hose and into a closed container, the user may not be able to determine when the water temperature has reached the desirable level. Thus, water that would be warm enough for a shower may be diverted into the container instead of used for the user's shower. Finally, this approach does not save water while the user showers, unless the user diverts water to the storage container during the shower.

U.S. Pat. No. 5,140,714 to Horenstein et al. discloses another device to catch potable water from a showerhead before the water reaches a desired temperature. A tube of waterproof material has a cuff that attaches the tube to a shower arm. The showerhead directs water through the tube to a container at the other end of the tube while the shower water warms. When the water has reached the desired temperature, the user removes the cuff from the shower arm. The container has a cover to protect the collected water from soap, shampoo, and bodily contaminants while the user showers. Although this approach saves the potable water that would otherwise be wasted while the user waits for the shower water to warm to a desired temperature, and it allows the user to detect when the water has reached the desired temperature, it does not save any water while the user showers. Moreover, the user must remember to attach the cuff to the shower arm before turning on the water, and the user must remove the cuff from the shower arm when the water is at the desired temperature, which may be inconvenient. Furthermore, the tube may be large, unwieldy, or unsightly.

U.S. Pat. No. 5,862,544 to Placencia discloses another apparatus for diverting, collecting, recapturing, and recycling potable water from a showerhead. A collection device includes a supported frame that is proximate to the showerhead and adjacent to a wall to which the showerhead is attached. The device also includes a movable water flow diverter assembly, capable of being moved from an in-use position to an at-rest position, and a collection container that is supported by the frame. When the diverter assembly is in the in-use position, water is diverted to the collection container. When the user needs access to the flow of water, the user moves the diverter assembly into the at-rest position, and the flow of water is no longer diverted. One disadvantage of this approach is that the collection device is elevated and therefore requires sufficient structure to support the weight of the collected water. Such structure may be expensive. Moreover, it may be difficult for some people to remove the collection container from the collection device because of the weight of the collected water and the height of the collection container. Another disadvantage is that because the diverter assembly directs the water into a closed container, the user may not be able to determine when the water temperature has reached the desirable level. Thus, water that would be warm enough for a shower may be diverted into the container instead of used for the user's shower. Yet another disadvantage of this approach is that the person taking a shower must remember to move the water flow diverter assembly from the at-rest position to the in-use position to collect water.

U.S. Pat. No. 5,168,586 to Small discloses a device used to reclaim shower waste water (i.e., grey water) for flushing toilets and watering gardens. A shower user stands on an apparatus placed on the shower floor. The top surface of the apparatus forms a sloped recess for collecting water, and an open inlet port at the recessed end allows the water to drain into the reservoir. A dispenser is used in conjunction with an outlet to retain and release the collected water. When the full reservoir is placed in an upright position on top of a toilet, the dispenser is manually actuated, thus releasing water through the outlet with sufficient flow rate to flush the toilet. A shoulder strap and sprinkler accessory may be attached for use as a portable watering container. Although this approach can capture significant amounts of grey water while a user showers, the apparatus may be expensive to manufacture because it needs to support the weight of a user, which may be two-hundred pounds or more, and it needs to be non-slip to prevent users from slipping. Moreover, when full, the apparatus may be heavy and unwieldy to remove from the shower. Finally, use of the apparatus may be dangerous because a user could inadvertently step or fall off of the apparatus while showering.

U.S. Pat. No. 6,581,218 to Koepenick discloses a water conservation system for separately collecting potable and non-potable water in a shower stall or a bathtub having a showerhead. The system includes a pair of receptacles placed on the floor of the shower stall. Each of the receptacles includes a cover, which has a hingedly connected panel to facilitate draining into a selected receptacle while a user is in the shower or bathtub. Collection of potable water is facilitated by directing the shower head at a first one of the receptacles when the water is warming up, and pivoting the shower head in the opposing direction when rinsing to direct grey (e.g., soapy) water into a second one of the receptacles. The appropriate receptacle cover panel is opened depending upon the positioning of the showerhead. Drains are formed in the tops of both receptacles, the tops having a drainage surface with a concave profile to direct water to a centrally positioned drain opening. One disadvantage of this approach is that because the showerhead disperses water, much of the water from the showerhead may miss the tops of the receptacles. Thus, the receptacles may not be able collect a substantial amount of water. Furthermore, the person taking a shower must remember to change the direction of the showerhead during his or her shower so as not to mix potable and non-potable water.

Many other proposed water conservation methods require modifications to premises plumbing. For example, U.S. Pat. No. 5,192,426 to DeCoster et al., U.S. Pat. No. 5,217,323 to Bilson, U.S. Pat. No. 5,465,434 to Coe, and U.S. Pat. No. 6,132,138 to Haese teach devices and methods for grey water capture and recycling. These systems all require direct connection to existing household plumbing systems, which requires permanent modification. Furthermore, they require extensive conduits and large storage reservoirs, which tend to be bulky and require further permanent modification of existing structures.

U.S. Patent Publication No. US 2013/0025686 by Norton discloses a household grey water capture and recycling system that captures water from showers and bathtubs before reaching the drain and therefore does not require alterations to existing plumbing. A shower pan covers the drain to allow water to pool. A water pickup and capturing means is positioned within the shower pan over the drain and transfers the water through sealed conduits to a temporary storage means, such as a tank or reservoir located outside the residence or a smaller indoor temporary storage vessel. A pump drives the flow of water through the system and has sufficient power to transfer water through elevation changes. Once the grey water is within the storage vessel, gravity or an alternate pump may be used to send the grey water to the desired irrigation distribution. One disadvantage of this system is the need for what is essentially a supplementary plumbing system for each bathroom in which the system is installed. It may be difficult or expensive to install the required conduit and pump, and, furthermore, these components may be expensive and unsightly.

Thus, there remains an ongoing need for a simple, inexpensive, easy-to-install way to collect water from a shower.

SUMMARY

Disclosed herein are apparatuses and methods for collecting water during a user's shower.

An apparatus for collecting water in a shower or bathtub enclosure comprises a panel comprising a water-resistant or waterproof material, one or more connectors coupled to or capable of being coupled to the panel, the one or more connectors enabling the panel to be disposed within the shower or bathtub enclosure, and a receptacle coupled to the panel, the receptacle having an opening for collecting water from a surface of the panel, the receptacle for delivering the collected water to a destination other than a drain of the shower or bathtub enclosure.

In some embodiments, the panel has a quadrilateral shape with a top edge and a bottom edge, and the one or more connectors are closer to the top edge than to the bottom edge, and the receptacle is closer to the bottom edge than to the top edge. In some such embodiments, the quadrilateral shape is substantially rectangular.

In some embodiments, the panel is flexible. In some embodiments, the water-resistant or waterproof material of the panel comprises metal, wood, vinyl, rubber, plastic, cloth, canvas, polyester, urethane, polyethylene, or fiberglass.

In some embodiments, the one or more connectors comprise one or more suction cups or one or more hooks.

In some embodiments, the receptacle comprises a pipe, and the opening is proximate to the panel. In some embodiments, the receptacle has a first end and a second end, and the first end is closed to prevent the collected water from flowing out of the first end. In some embodiments, the receptacle includes a valve having a first position and a second position. In some such embodiments, the first position allows the collected water to flow to the destination, and the second position prevents the collected water from flowing to the destination. In other such embodiments, the first position directs the collected water to the destination, and the second position directs the collected water to a different destination.

In some embodiments, the apparatus further comprises the destination, and the destination comprises a container. In some such embodiments, the container includes a lid with a valve enabling air to escape from the container as the collected water fills the container. In some such embodiments, the valve is a one-way valve configured to allow the collected water to enter the container and to prevent leakage of water from the container when the container is full.

In some embodiments, the apparatus further comprises a channel having a first end and a second end, and the first end of the channel is coupled to the receptacle and the second end of the channel is coupleable to the destination. In some such embodiments, the channel comprises a hose, such as a food-grade hose. In some embodiments having a channel, at least a portion of the channel is flexible. In some embodiments, the channel delivers the collected water to more than one destination.

In some embodiments, the apparatus includes a pump coupled to the receptacle and coupleable to the destination, the pump for pumping the collected water to the destination.

BRIEF DESCRIPTION OF THE DRAWINGS

The disclosure herein is illustrated by way of example, and not by way of limitation, in the figures of the accompanying drawings, in which like reference numerals refer to similar elements and in which.

DETAILED DESCRIPTION

The following description is made for the purpose of illustrating the general principles of the present disclosure and is not meant to limit the inventive concepts claimed herein. Furthermore, unless stated otherwise herein, particular described features can be used in combination with other described features in each of the various possible combinations and permutations.

Figure 1:
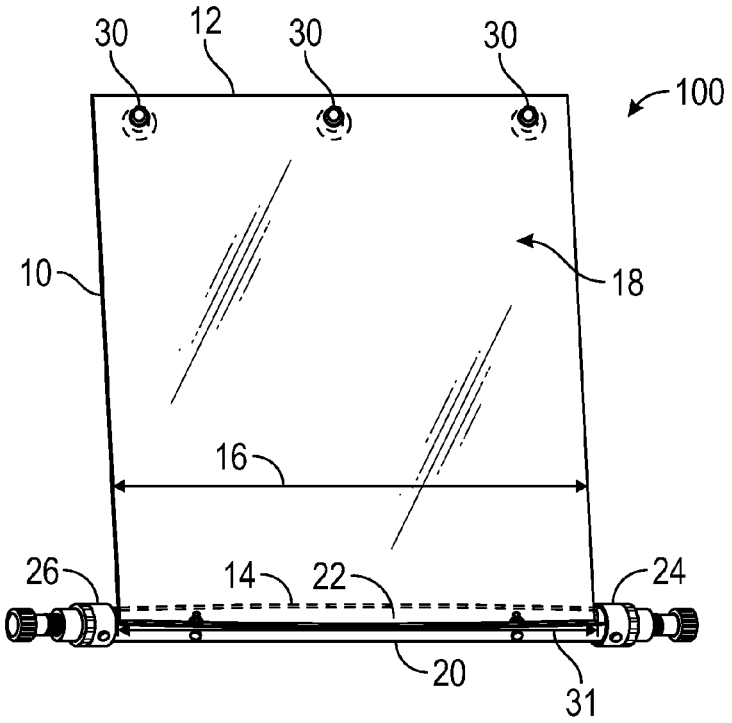
FIG. 1 illustrates a water collection apparatus in accordance with some embodiments.

FIG. 1 illustrates an exemplary water collection apparatus 100 in accordance with some embodiments. The apparatus 100 includes a panel 10 having a top edge 12, a bottom edge 14, and a front surface 18. One or more connectors 30 are coupled to the panel 10 near or at the top edge 12 to enable the apparatus 100 to be hung from or temporarily attached to a vertical surface (e.g., a wall, a window, a door, etc.) of a shower or bathtub enclosure. The exemplary embodiment illustrated in FIG. 1 has three connectors 30 coupled to the panel 10. When the apparatus 100 is hung from or temporarily attached to the vertical surface of the shower or bathtub enclosure, the front surface 18 of the panel 10 faces the interior of the shower or bathtub enclosure (i.e., where a person taking a shower stands).

The apparatus 100 also includes a receptacle 20 that is coupled to the panel 10 near or at the bottom edge 14 of the panel 10. In the exemplary embodiment shown in FIG. 1, the receptacle 20 has a first end 24 and a second end 26. The receptacle 20 has at least one opening 22 that allows water from the front surface 18 of the panel 10 to be collected in the receptacle 20 when the apparatus 100 is hung from or temporarily attached to the vertical surface of the shower or bathtub enclosure. Although FIG. 1 and other drawings herein show exemplary embodiments having only one opening 22, the receptacle 20 may have more than one opening 22 or, conversely, opening 22 may comprise perforations in the receptacle 20 (e.g., a set of holes or slits in the receptacle 20).

Figure 2:
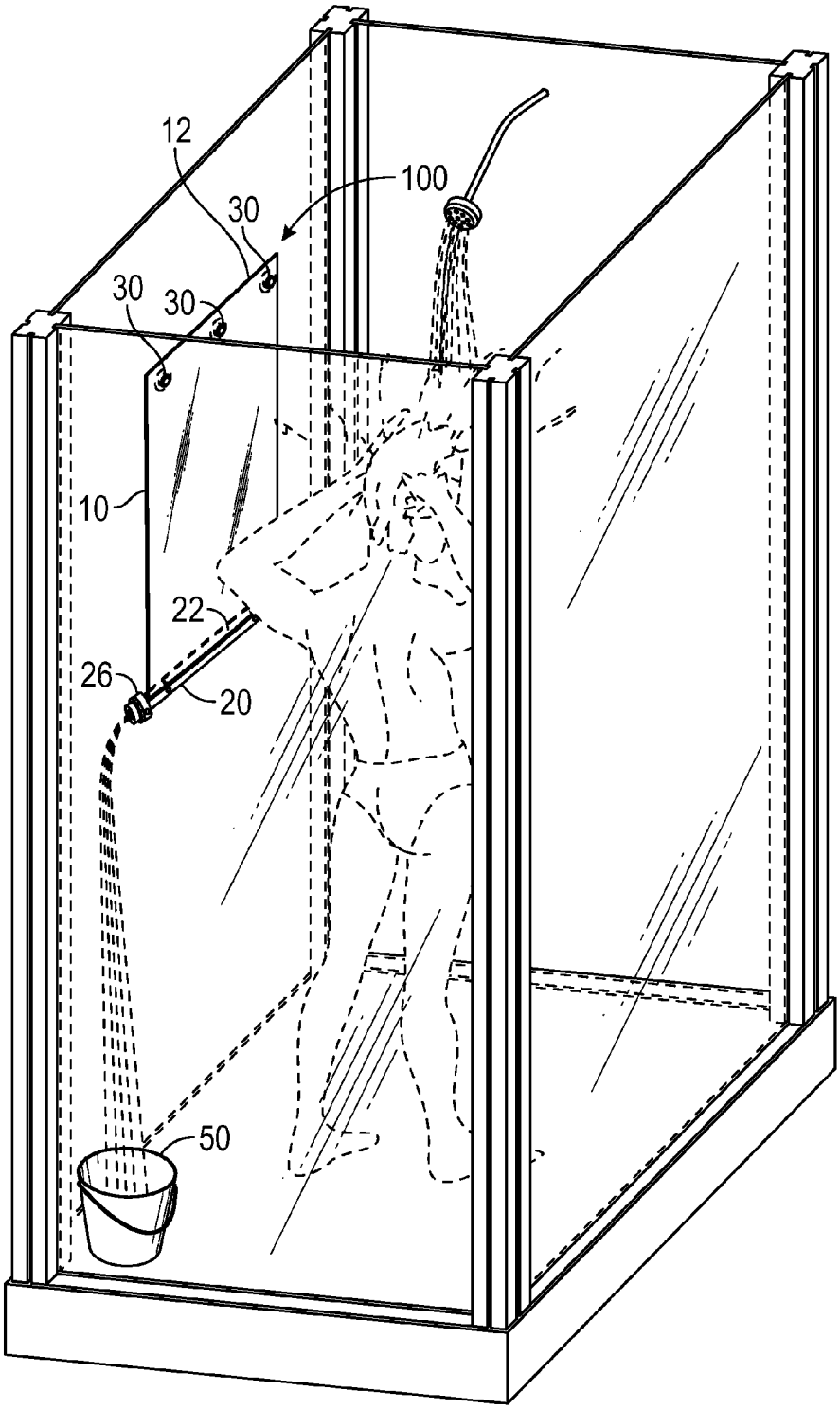
FIG. 2 illustrates a water collection apparatus disposed within a shower enclosure in accordance with some embodiments.

When the apparatus 100 has been hung from or temporarily attached to the vertical surface of the shower or bathtub enclosure, water emerging from a showerhead that hits the front surface 18 of the panel 10 drips into the receptacle 20 through the opening 22. To facilitate the collection of water, the user may direct the showerhead toward the panel 10. The apparatus 100 may be attached to or hung from any location in a shower or bathtub enclosure where it can collect water. For example, the apparatus 100 may be hung from or temporarily attached to the wall or surface that is opposite (facing) the showerhead, thereby capturing water passing the person taking a shower. Alternatively, the apparatus 100 may be hung from or temporarily attached to a wall or surface that is perpendicular to the wall to which the showerhead is attached, i.e., a side wall or surface of the shower or bathtub enclosure. FIG. 2 illustrates such a placement, which may be particularly advantageous if the user directs the showerhead toward the vertical surface, and thereby toward the panel 10, during the shower. As yet another example, the apparatus 100 may be hung from or temporarily attached to the wall to which the showerhead is attached.

It is to be understood that although this disclosure assumes that the apparatus 100 is hung from or temporarily attached to a vertical surface of a shower or bathtub enclosure, the apparatus 100 may alternatively be mounted in different ways or on or near other structures. For example, the apparatus 100 may be hung from a ceiling such that it is disposed within a shower or bathtub enclosure at all. As another example, the apparatus 100 need not be in a shower or bathtub enclosure. For example, the apparatus 100 may be hung from or attached to a structure to capture indoor water (e.g., from a bathroom or kitchen sink, etc.) or outdoor water (e.g., rain, sprinkler runoff, etc.). The fact that exemplary embodiments are illustrated or discussed as having the apparatus 100 hung from or temporarily attached to a vertical surface of a shower or bathtub enclosure is not intended to limit the scope of the disclosure.

The panel 10 may be water-resistant or waterproof so that the panel 10 does not absorb significant amounts of water. Examples of waterproof or water-resistant materials include, but are not limited to, metal, wood, vinyl, rubber, plastic, cloth, canvas, polyester, urethane, polyethylene, and fiberglass.

The panel 10 may have any shape that enables the apparatus 100 to collect a desired amount of water from a showerhead. For example, the shape of the panel 10 may be a quadrilateral (where quadrilaterals include, among other shapes, rectangles, squares, trapezoids, rhombuses, diamonds, and parallelograms), a hexagon, a circle, an oval, a triangle, a pentagon, a heptagon, an octagon, or any other appropriate shape, including an irregular shape. In the embodiment shown in FIG. 1, the panel 10 has a quadrilateral (rectangular) shape.

The panel 10 may have any size that enables the apparatus 100 to collect a desired amount of water from a showerhead. In some embodiments, the size of the panel 10 is large enough that, when the apparatus 100 is mounted on the vertical surface of the shower or bathtub enclosure and the showerhead is aimed at or near the center of the panel 10, substantially all of the water emerging from the showerhead hits the front surface 18 of the panel 10. In some embodiments in which the panel 10 has a quadrilateral shape, the panel 10 has a width 16 of approximately three feet and a height (i.e., a distance between the top edge 12 and the bottom edge 14) of approximately two feet. The panel width 16 and height may be any convenient lengths. Moreover, the panel 10 may be taller than it is wide or vice versa. Exemplary dimensions (height by width or vice versa) for a rectangular panel 10 are 20 inches by 24 inches, 24 inches by 30 inches, 30 inches by 36 inches, etc.

In some embodiments, some or all of the panel 10 is flexible (i.e., malleable, capable of stretching or being stretched, capable of bending or being bent, etc.), thus enabling the panel 10 to fit over protrusions (e.g., soap dishes, handles, towel bars, etc.) extending out of the vertical surface of the shower or bathtub enclosure. In some embodiments, the panel 10 comprises vinyl, rubber, plastic, cloth, canvas, polyester, urethane, polyethylene, fiberglass, or any waterproof or water-resistant flexible material that resists or repels water.

The receptacle 20 may be made of any waterproof or water-resistant material. Examples of waterproof or water-resistant materials include, but are not limited to, metal, wood, vinyl, rubber, plastic, cloth, canvas, polyester, urethane, polyethylene, and fiberglass. In some embodiments, the receptacle 20 is made of polyvinyl chloride (PVC). The receptacle 20 may be treated with or coated by a material (e.g., a resin) to improve its water-resistance or to make the receptacle 20 substantially or entirely waterproof.

The receptacle 20 may be rigid or flexible. The receptacle 20 may expand as it collects water from the front surface 18 of the panel 10. The receptacle 20 may have a rigid exterior but a flexible or expandable interior. For example, the receptacle 20 may include inside a bladder that collects water from the front surface 18 of the panel 10. The bladder may expand or stretch as it fills with water.

The receptacle 20 may have any appropriate shape. In the exemplary embodiment illustrated in FIG. 1, the receptacle 20 is cylindrical. Other appropriate shapes include, but are not limited to, cuboids, rhombohedrons, spheres, and hexagonal prisms.

In some embodiments, the receptacle 20 comprises a pipe (e.g., a PVC pipe). In some such embodiments, the opening 22 is the result of a length-wise cut through the surface of the pipe.

The receptacle 20 may have any size that allows the receptacle 20 to capture a desired amount and flow-rate of water from the front surface 18 of the panel 10 when a user takes a shower. In some embodiments, the size of the receptacle 20 enables the receptacle 20 to capture substantially all of the water from the front surface 18 of the panel 10 during a user's shower without overflowing. In some embodiments, the size of the receptacle 20 enables the receptacle 20 to divert, at an appropriate rate, substantially all of the water captured from the front surface 18 of the panel 10 to a destination. When the apparatus 100 is disposed in a shower or bathtub enclosure, the destination is somewhere other than the drain of the shower or bathtub down which water from a shower or bath would normally flow. In some embodiments, including in the exemplary embodiment shown in FIG. 1, the length of the receptacle 20 (i.e., the distance between the first end 24 and the second end 26) is greater than the width of the panel 10 and greater than the length 31 of the opening 22.

The receptacle 20 may be coupled to the panel 10 using any appropriate means. For example, the receptacle 20 may be directly attached to the panel 10 by one or more fasteners. Examples of fasteners include, but are not limited to, rivets, screws, pins, bolts, sockets, rods, studs, anchors, staples, hooks, wires, adhesives, suction cups, snaps, hooks, Velcro®, hook and eye fasteners, and nails. The receptacle 20 may be permanently coupled to the panel 10, or the receptacle 20 may be removable from the panel 10.

In some embodiments, the only opening in receptacle 20 is the opening 22, and the receptacle 20 temporarily stores at least some amount of the water collected from the front surface 18 of the panel 10. In some such embodiments, the receptacle 20 may be removed from the panel 10 so that the receptacle 20 can be transported to a destination (e.g., a toilet, a garden, etc.) where the collected water may be removed from the receptacle 20. In some embodiments in which the receptacle 20 may be removed from the panel 10, the receptacle 20 may include a cover (not shown) for the opening 22 so that when the receptacle 20 is removed from the panel 10, the collected water does not leak out of the receptacle 20 through the opening 22. The cover may be attached to the receptacle using any appropriate means (e.g., one or more hinges). The cover may separate from the receptacle 20. The cover may include one or more rubber gaskets or flanges to prevent or mitigate leakage when the user moves the receptacle 20 to the destination while the cover is in place. The opening 22 may have a lip (not shown) over which the cover fits. As an example, the cover may fit over the opening 22 similarly or identically to the way a Tupperware® lid fits over a Tupperware® container.

In some embodiments in which the receptacle 20 may be removed from the panel 10, the receptacle 20 has both the opening 22 and an opening in either the first end 24 or the second end 26, and the opening in the first end 24 or the second end 26 is kept closed (e.g., using a plug, valve, etc.) while receptacle 20 fills with the collected water. When the user has transported the receptacle 20 to a destination, the user can open the opening in the first end 24 or the second end 26 to drain the water from the receptacle 20.

The opening 22 in the receptacle 20 has a length 31, which may be larger than, smaller than, or equal to the width 16 of the panel 10. In the exemplary embodiment illustrated in FIG. 1, the length 31 of the opening 22 is slightly larger than the width 16 of the panel 10.

Some or all of the bottom edge 14 of the panel 10 may be adjacent to, inside, or outside of the receptacle 20. Similarly, some or all of the bottom edge 14 of the panel 10 may be adjacent to, inside, or outside of the opening 22. In some embodiments, all or a portion of the bottom edge 14 of the panel 10 passes through the opening 22 so that a portion of the panel 10 is inside of the receptacle 20. In some such embodiments, the panel 10 is coupled to the receptacle 20 using one or more fasteners inside of the receptacle 20. Examples of suitable fasteners include, but are not limited to, rivets, screws, pins, bolts, sockets, rods, studs, anchors, staples, hooks, wires, adhesives, suction cups, snaps, hooks, Velcro®, hook and eye fasteners, and nails.

Figure 3:
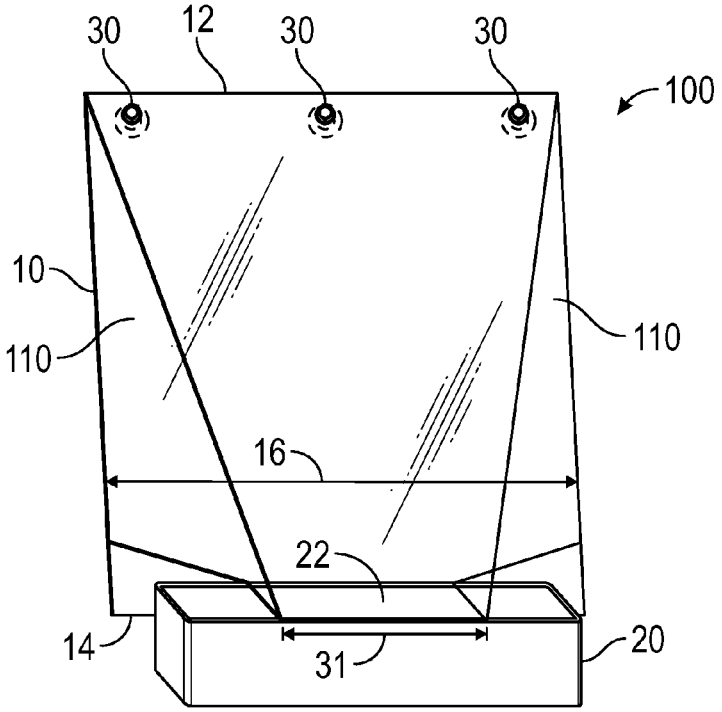
FIG. 3 illustrates a water collection apparatus in accordance with some embodiments.

In some embodiments, the length 31 of the opening 22 is less than the width 16 of the panel 10. In some such embodiments, one or more flanges may be attached to, or may be an integral part of, the panel 10 to direct water on the front surface 18 of the panel 10 to the opening 22 in the receptacle 20. FIG. 3 illustrates an exemplary embodiment in which the length 31 of the opening 22 in the receptacle 20 is less than the width 16 of the panel 10, and the panel 10 includes or has attached thereto a pair of flanges 110 to direct water on the front surface 18 of the panel 10 to the opening 22. The flanges 110 may be flexible or rigid. The flanges 110 may be made of any material that would be suitable for the panel 10 (i.e., any water-resistant or waterproof material, examples of which are provided above). The flanges 110 may be made of the same material as the panel 10, or they may be made of a different material. The positions of the flanges 110 relative to the panel 10 and/or the receptacle 22 may be fixed, or they may be adjustable. The flanges 110 may be removable from the apparatus 100. In embodiments in which the flanges 110 are removable, the flanges 110 may be attached to the apparatus 100 using any suitable fastener. Examples of suitable fasteners include, but are not limited to, rivets, screws, pins, bolts, sockets, rods, studs, anchors, staples, hooks, wires, adhesives, suction cups, snaps, hooks, Velcro®, hook and eye fasteners, and nails.

In some embodiments, the receptacle 20 is configured to deliver the collected water to a destination without being removed from the panel 10. The destination may be, for example, a bucket, a toilet, a tank, a planter box, a plant pot, or an outdoor location such as a garden or lawn. Other destinations may also be appropriate, and the examples given herein are not intended to limit the scope of the claimed invention.

In some embodiments, the receptacle 20 includes a valve having two positions or settings, one of which allows the collected water to flow to the destination, and the other of which prevents the collected water from flowing to the destination. By setting the valve in the position that prevents the collected water from flowing to the destination during certain phases of a shower, a person taking a shower can divert to the destination only (or primarily) water that is free of soap, shampoo, and bodily contaminants. When the valve is in the position that prevents the collected water from flowing to the destination, the collected (grey) water may eventually exceed the capacity of the receptacle 20 and flow down the drain of the shower or bathtub enclosure.

Figure 4:
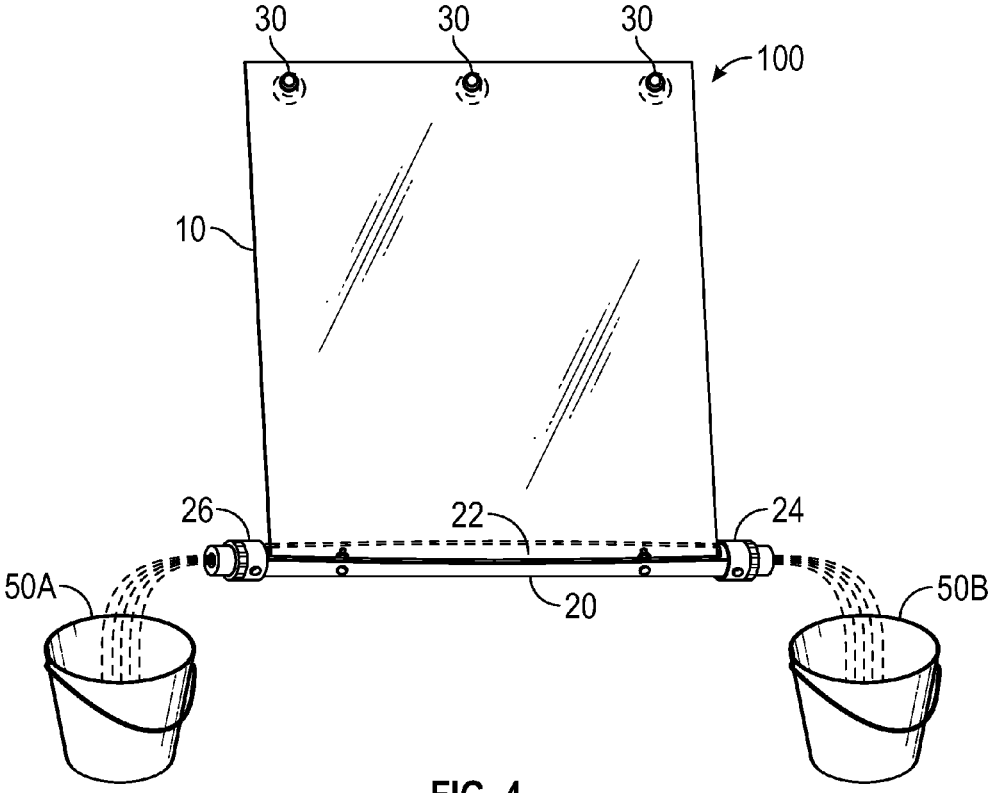
FIG. 4 illustrates a water collection apparatus and two destinations in accordance with some embodiments.

In some embodiments in which the receptacle 20 is configured to deliver the collected water to one or more destinations, both the first end 24 and the second end 26 of the receptacle 20 are partially or fully open to allow the collected water to emerge from the receptacle 20 through the first end 24 and the second end 26 at a rate that prevents the collected water from overflowing out of the receptacle 20 through the opening 22. FIG. 4 illustrates an exemplary embodiment in which both the first end 24 and the second end 26 are at least partially open, and the collected water emerges from the receptacle 20 into destinations 50A and 50B, which are shown as buckets. In the illustrated embodiment, the collected water emerging from the first end 24 of the receptacle falls into the destination 50B, which is positioned so as to capture the collected water emerging from the first end 24 of the receptacle 20. Likewise, the collected water emerging from the second end 26 of the receptacle 20 falls into the destination 50A, which is positioned so as to capture the collected water emerging from the second end 26 of the receptacle 20. As discussed below, one or both of the first end 24 and the second end 26 may be coupled to one or more channels that assist in the delivery of the collected water to the destination(s). Moreover, the receptacle 20 may include a valve (not shown) having two positions or settings, one of which allows the collected water to flow to the destination 50A, and the other of which allows the collected water to flow to the destination 50B. By designating the destination 50A as the "clean" water destination and the destination 50B as the grey water destination (or vice versa) and setting the valve appropriately during the course of a shower, a person taking a shower can direct to the destination 50A only (or primarily) water that is free of soap, shampoo, and bodily contaminants, and direct grey water to the destination 50B.

Figure 5:
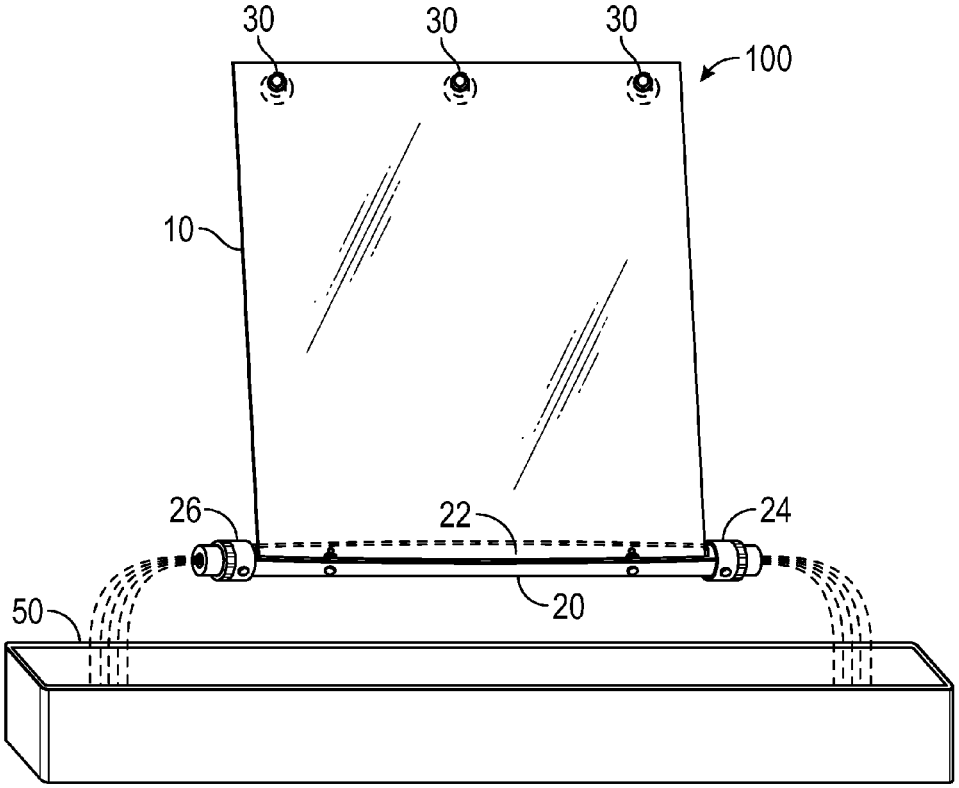
FIG. 5 illustrates a water collection apparatus and a destination in accordance with some embodiments.

FIG. 5 illustrates an exemplary embodiment in which both the first end 24 and the second end 26 are at least partially open, and the water emerging from the receptacle 20, whether from the first end 24 or the second end 26, flows into the same destination 50, shown as a trough, which is of sufficient size to simultaneously collect water emerging from both ends of the receptacle 20. One or both of the first end 24 and the second end 26 may be coupled to one or more channels that assist in the delivery of the collected water to the destination 50.

In some embodiments, either the first end 24 or the second end 26 of the receptacle 20 is closed to prevent the collected water from emerging from the receptacle 20 through the closed end. For simplicity, this disclosure assumes that the first end 24 is the closed end, but it is to be understood that the second end 26 may just as well be the closed end in embodiments in which one of the ends of receptacle 20 is closed.

Figure 8:
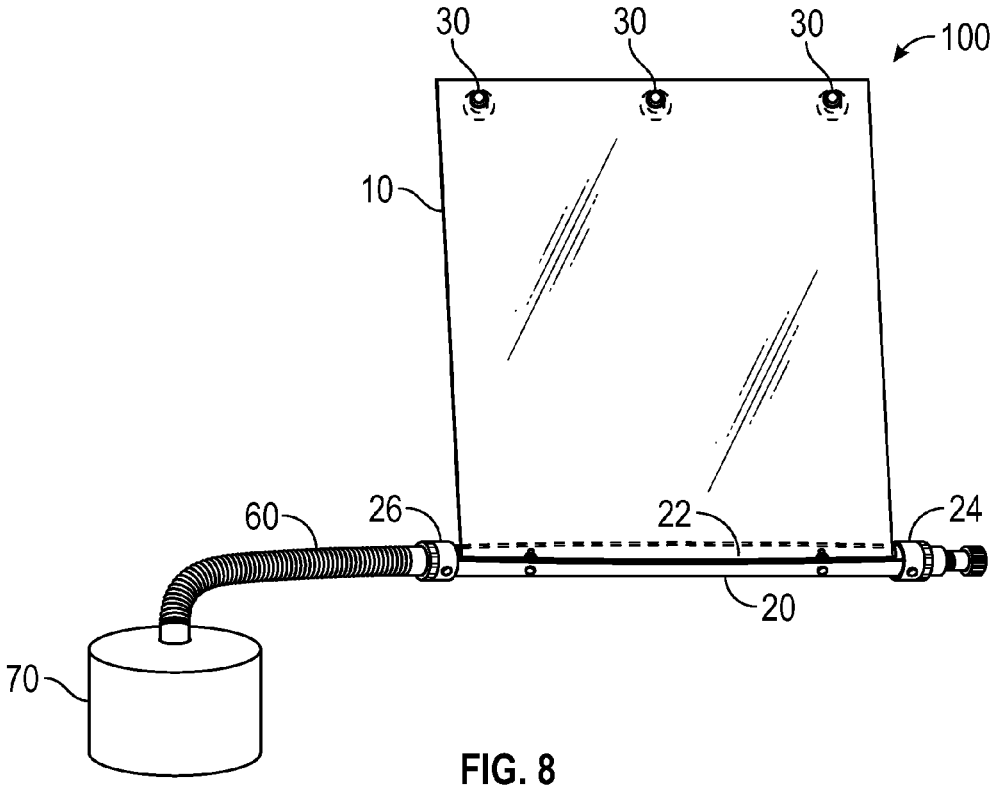
FIG. 8 illustrates a water collection apparatus coupled to a destination by a channel in accordance with some embodiments.
Figure 10:
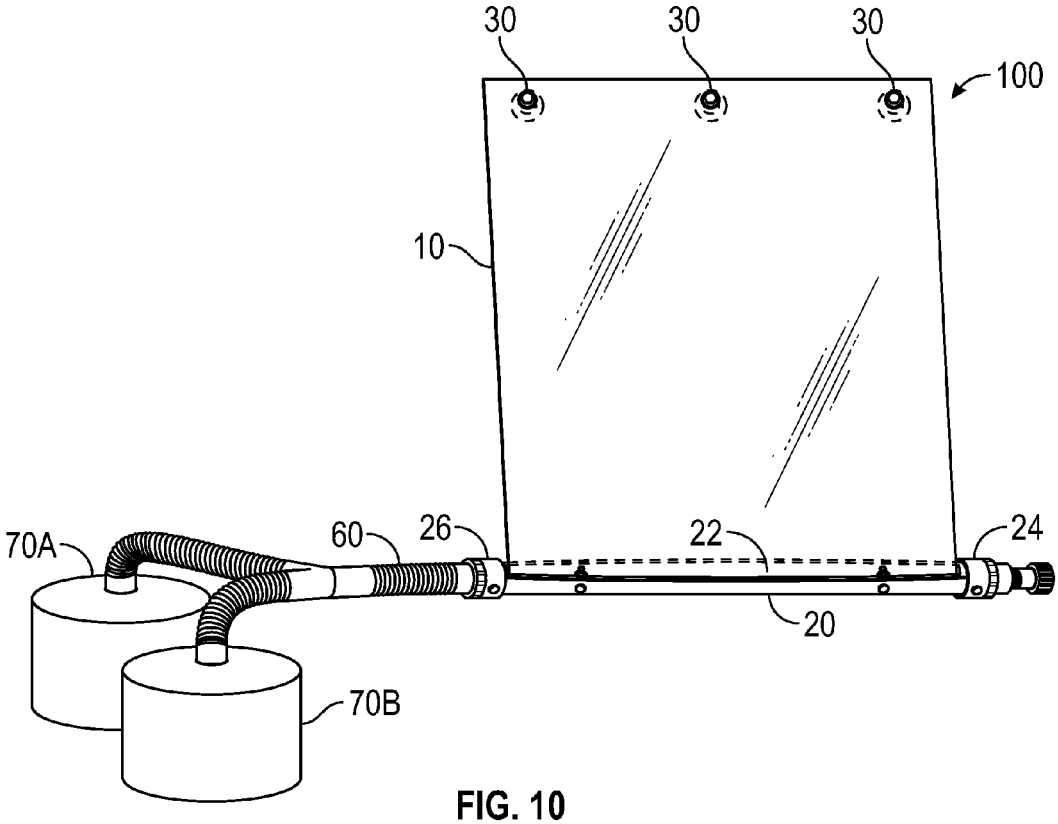
FIG. 10 illustrates a water collection apparatus and multiple destinations in accordance with some embodiments.
Figure 11:
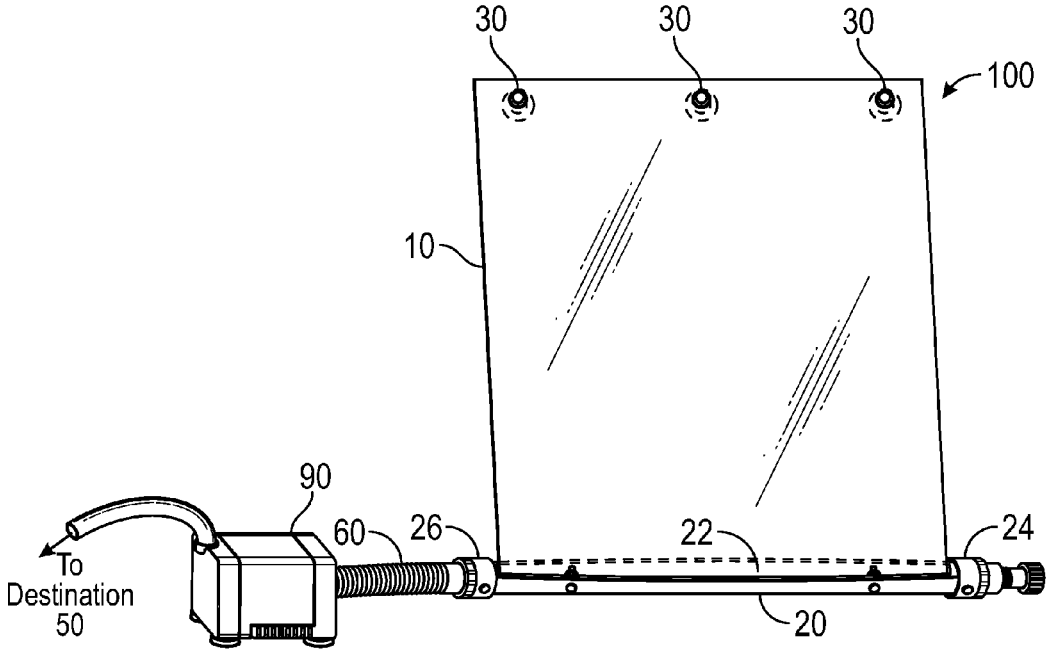
FIG. 11 illustrates a water collection apparatus and a pump for delivering collected water to one or more destinations in accordance with some embodiments.

In some embodiments in which the first end 24 of the receptacle 20 is closed, the second end 26 of the receptacle 20 is coupled to a destination (e.g., a bucket, toilet, tank, planter box, plant pot, outdoor location, etc.) through at least one channel, thereby allowing the collected water to be delivered to the destination. FIG. 8, FIG. 10, and FIG. 11, discussed in more detail below, illustrate exemplary embodiments in which the first end 24 is closed and the second end 26 facilitates the delivery of the collected water to a destination through one or more channels.

Figure 6:
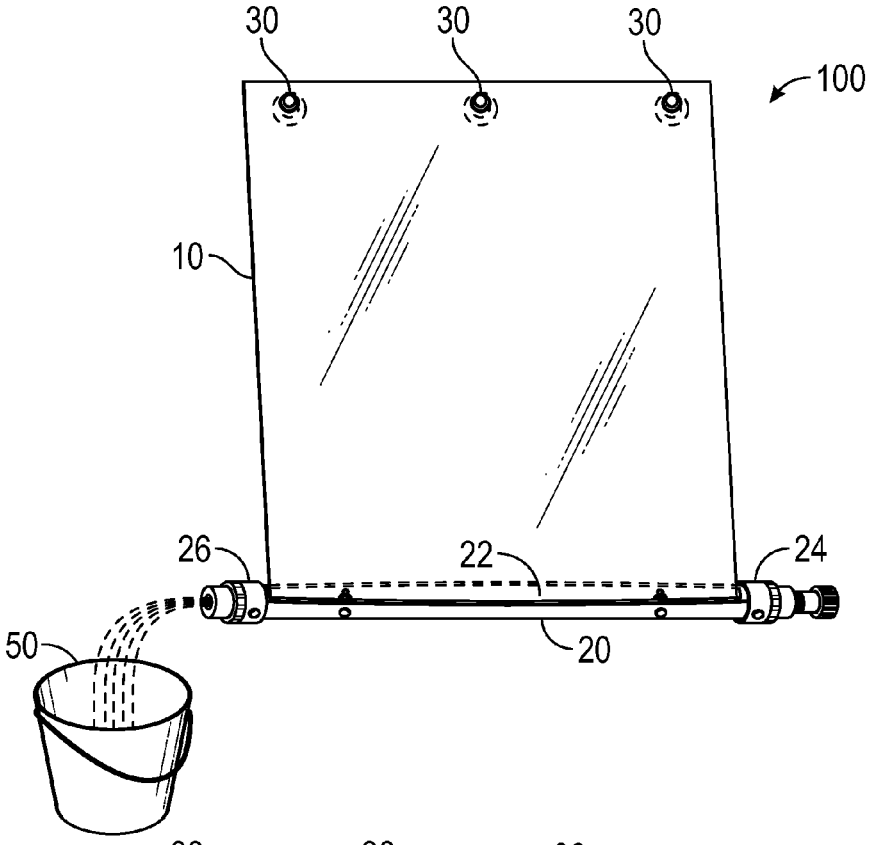
FIG. 6 illustrates a water collection apparatus and a destination in accordance with some embodiments.

In other embodiments in which the first end 24 of the receptacle 20 is closed, the second end 26 of the receptacle 20 is open, and the collected water directly enters the destination 50, which is positioned so as to capture the collected water emerging from the second end 26 of the receptacle 20. FIG. 6 illustrates one such exemplary embodiment in which the destination 50 is a bucket. As shown, the collected water flows out of the second end 26 and into the destination 50.

Figure 7:
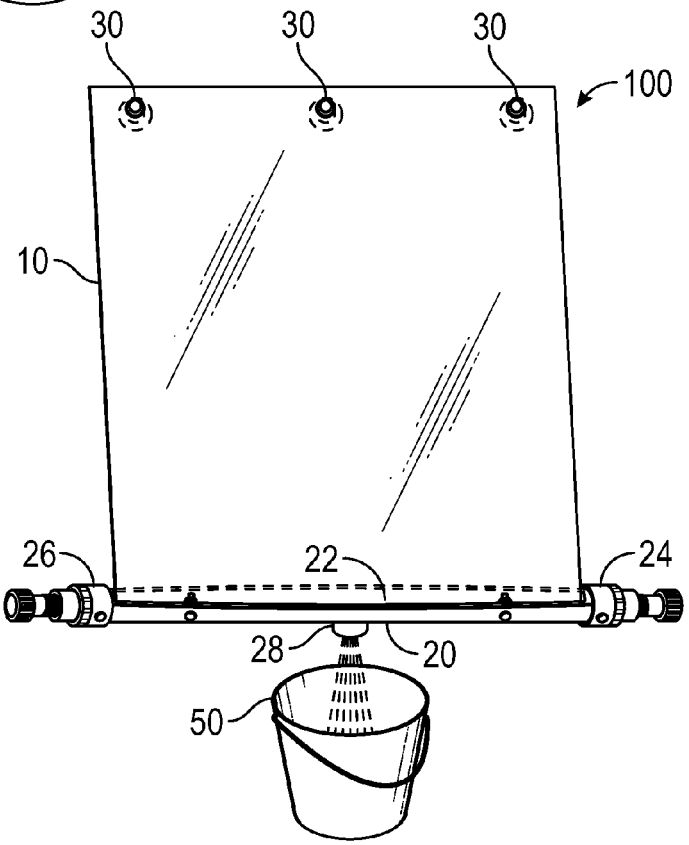
FIG. 7 illustrates a water collection apparatus and a destination in accordance with some embodiments.

In some embodiments, both the first end 24 and the second end 26 are closed, and a drain elsewhere in the receptacle 20 allows the collected water to flow from the receptacle 20 to the destination 50. FIG. 7 illustrates one such exemplary embodiment in which the receptacle 20 includes a drain 28 through which the collected water flows to the destination 50 (shown as a bucket). Although FIG. 7 illustrates the drain 28 as being substantially in the middle of the receptacle 20, the drain 28 may be located at any convenient location on the receptacle 20. Moreover, although FIG. 7 illustrates the drain 28 being located at or near the bottom of the receptacle 20, the drain 28 may be located elsewhere, such as on the front of the receptacle 20.

One or more connectors 30 enable the apparatus 100 to be hung from or temporarily attached to a vertical surface (e.g., a wall, a window, a door, etc.) of a shower or bathtub enclosure. The one or more connectors 30 may be any suitable connectors for holding the apparatus 100 in place. The one or more connectors 30 may adhere to or be attached to the vertical surface of the shower or bathtub enclosure and/or the panel 10. The one or more connectors 30 may provide for a temporary mounting of the apparatus 100 on or adjacent to the vertical surface so that the apparatus 100 may be removed.

To mitigate tearing or abrasion of the panel 10 caused by the one or more connectors 30 and the weight of the collected water, the panel 10 may include one or more holes through which one or more protective devices (not shown) may be inserted. The one or more connectors 30 may pass through or be attached to the panel 10 via the one or more protective devices. Examples of suitable protective devices include, but are not limited to, grommets, rings, edge strips, and eyelets. The one or more protective devices may be flared or collared on each side to keep them in place, and they may be made of metal, plastic, rubber, or any other suitable material.

In some embodiments, the one or more connectors 30 are suction cups that enable the apparatus 100 to be coupled to the vertical surface by suction. In some embodiments in which the one or more connectors 30 are one or more suction cups, the one or more suction cups are attached to the panel 10. The one or more suction cups may be permanently attached to the panel 10, or they may be removable and replaceable. In some embodiments using suction cups for the one or more connectors 30, the one or more suction cups are unitary pieces that attach to the panel 10 through holes in the panel 10. In other embodiments, the one or more suction cups have two portions, one of which passes through a hole in the panel 10 and is joined to the other portion to hold the suction cup in place. In some embodiments using one or more suction cups, each suction cup accepts a fastener that holds the suction cup in place relative to the panel 10. The fastener may be any suitable fastener, such as, for example, an aluminum or plastic screw to prevent rusting or corrosion. Examples of suitable suction cups include, but are not limited to, Darice® Suction Cups, TAP® Plastics Vinyl Suction Cups, and Source One® Premium Large Clear Suction Cups.

In some embodiments, the one or more connectors 30 are hooks that enable the apparatus 100 to be hung from or adjacent to the vertical surface (e.g., when the vertical surface is a shower door or a tub enclosure door, the one or more connectors 30 may be one or more hooks that extend over the top of the door). In some embodiments in which the one or more connectors 30 are one or more hooks, the one or more hooks are temporarily or permanently attached to the panel 10. In some embodiments in which the one or more connectors 30 are one or more hooks, the panel 10 has a number of holes equal to the number of connectors 30, and, for each hole, one end of one of the hooks is inserted through the hole, and the other end is coupled to the vertical surface. Examples of suitable hooks include, but are not limited to, shower curtain hooks, S-hooks, and hardware hooks.

In some embodiments, the one or more connectors 30 are one or more adhesive strips. The one or more adhesive strips may be permanently attached to the panel 10, or they may be removable from the panel 10. The one or more adhesive strips may be permanently attached to the vertical surface, or they may be removable from the vertical surface. The one or more adhesive strips may have two sticky surfaces, one of which sticks to the panel 10 or to another portion of the apparatus 100 (e.g., the receptacle 20), and the other of which sticks to the vertical surface. Examples of suitable adhesive strips include, but are not limited to, 3M® Command™ Water Resistant adhesive strips and Velcro®.

In some embodiments, the one or more connectors 30 combine features of suction cups, hooks, and/or adhesive strips to enable the apparatus 100 to be mounted on or adjacent to the vertical surface. For example, the one or more connectors 30 may be suction cups with hooks from which the panel 10 may be hung, where the suction cups can adhere to the vertical surface. Examples of suitable connectors 30 of this type include, but are not limited to, FrogsFeet™ Large Suction Cups with Hooks. As another example, the one or more connectors 30 may be hooks, from which the panel 10 may be hung, with adhesive strip backings enabling the hooks to adhere to the vertical surface. Examples of suitable connectors 30 of this type include, but are not limited to, 3M® Command™ Bathroom Hooks.

Although the drawings herein illustrate the one or more connectors 30 being located near the top edge 12 of the panel 10, some or all of the connectors 30 may be located elsewhere on the panel 10. For example, some or all of the connectors 30 may be located along the perimeter of the panel 10, whatever the shape of the panel 10. As another example, if the panel 10 is made of a rigid material, the one or more connectors 30 may be located toward the center of the panel 10. Furthermore, some or all of the connectors 30 may be coupled to the receptacle 20.

Although in many embodiments disclosed herein the apparatus 100 is attached to or hung from a shower or bathtub enclosure in a temporary manner, it is also possible to attach the apparatus 100 more permanently, such as by using waterproof glue, nails, screws, etc. Also, as stated previously, it is possible to mount the apparatus 100 to an indoor or outdoor surface or structure other than a vertical wall of a shower or bathtub enclosure (e.g., a ceiling, a sink, a roof, a shed, a vehicle window, etc.).

The types, strengths, and placements relative to the panel 10 of the one or more connectors 30 should be selected so that the apparatus 100 remains in place on or relative to the vertical surface when the apparatus 100 is in use. Thus, in embodiments in which the receptacle 20 is configured to hold the collected water rather than divert it to a destination 50, the one or more connectors 30 should be of a type and strength, and should have placements relative to the panel 10, that prevent the weight of the receptacle 20 from dislodging the apparatus 100 from the vertical surface of the shower or bathtub enclosure when the receptacle 20 is full. In embodiments in which the receptacle 20 is configured to hold the collected water rather than divert it to a destination 50, it may be desirable to use hooks as the one or more connectors 30 to hang the apparatus 100 from a wall, window, or door of the shower or bathtub enclosure. Of course, it is possible to attach the apparatus 100 to, or hang the apparatus 100 from, a permanent or semi-permanent feature of the shower or bathtub enclosure, such as a towel bar. Likewise, it is possible to install a permanent or semi-permanent feature (e.g., one or more hooks or a towel bar) from which to hang the apparatus 100.

In some embodiments, the receptacle 20 is coupled to a channel for delivering the collected water to one or more destinations 50. FIG. 8 illustrates an exemplary embodiment of an apparatus 100 with a channel 60 for delivering the collected water from the receptacle 20 to a container 70. As illustrated in FIG. 8, the first end 24 of the receptacle 20 is closed, and the channel 60 is coupled to the second end 26 of the receptacle 20, which allows the collected water to flow from the receptacle 20 through the channel 60 to the container 70. In some embodiments, the second end 26 of the receptacle 20 includes or is coupled to a hose connector or fitting, and the channel 60 is a hose that includes or is coupled to a complementary hose connector or fitting that enables the channel 60 to be coupled to the second end 26 of the receptacle 20.

Although FIG. 8 illustrates the channel 60 coupled to the second end 26 of the receptacle 20, the channel 60 may be coupled to the receptacle 20 elsewhere. For example, if both the first end 24 and the second end 26 of the receptacle 20 are closed, the channel 60 may be coupled to the receptacle 20 at an intermediate point, such as the drain 28 illustrated in FIG. 7. In addition, FIG. 8 illustrates a single channel 60, but it is to be understood that the apparatus may have multiple channels coupled to different parts of the receptacle 20. For example, if both the first end 24 and the second end of the receptacle 20 are open, a second channel may be coupled to the first end 24. As another example, another channel may be coupled to the receptacle 20 at an intermediate point, such as the drain 28 illustrated in FIG. 7.

In some embodiments, the channel 60 is directly connected to the receptacle 20. For example, the channel 60 may be screwed into or onto the receptacle 20. In some embodiments, the channel 60 is attached to the receptacle 20 by or through a fastener. In such embodiments, the fastener may be any applicable fastener, such as, by way of example and not limitation, a pipe fitting, a coupling, a hose connector or fitting, a joint, a sleeve, or a valve, or any of the other fasteners listed elsewhere herein.

In some embodiments, the channel 60 is permanently attached to the receptacle 20. In other embodiments, such as when the channel 60 is a hose that may be coupled to the receptacle 20 by a hose connector or fitting, the channel 60 may be removed from the receptacle 20.

In some embodiments, the channel 60 is flexible or includes at least one flexible portion. In some embodiments, the channel 60 is or comprises a hose. The hose may be, for example, a food-grade hose to mitigate mold, mildew, and other undesirable consequences of water running through or contacting a hose. Alternatively, the hose may be another type of hose, such as garden hose or a suction and transfer hose that might be used in agricultural, marine, water, pool and spa, construction, or any other industrial use.

In some embodiments, the channel 60 is rigid or includes at least one rigid portion. In some embodiments, the channel 60 is or comprises a pipe, such as, for example, PVC pipe.

In embodiments using a channel 60, in order to prevent the collected water from flowing out of the receptacle 20 through the opening 22, the size (e.g., diameter) of the channel 60 should accommodate the maximum expected volume per unit of time of collected water flowing from the receptacle 20 to the destination 50 (e.g., the container 70).

The length of the channel 60 should be selected to enable the collected water to reach the destination 50. The destination 50 may be, for example, a container 70 located inside of the shower or bathtub enclosure, in which case the channel 60 should be a first length that is long enough to reach the container 70. As another example, the destination 50 may be a container 70 situated outside of the shower or bathtub enclosure, in which case the channel 60 should be a second length that is long enough to reach the container 70. As yet another example, the apparatus 100 may be located in a second-story shower or bathtub enclosure, and the destination 50 may be a ground-level garden or a ground-level container. In this case, the channel 60 should be a third length that is long enough to reach the ground-level garden or container.

Although the destination shown in FIG. 8 is a closed container 70, it is to be understood that the destination need not be a container at all, much less a closed container. As discussed elsewhere, the destination may be, for example, a bucket (with or without a lid), a toilet, a tank, a garden, a lawn, a flower pot, a planter box, or any other destination appropriate to receive the collected water. Furthermore, although FIG. 8 illustrates the channel 60 as being directly connected to the container 70, the channel 60 need not be connected to the destination. For example, the collected water may emerge from the channel 60 in a free-flowing manner, like the collected water shown emerging from the receptacle 20 in FIGS. 4-7.

In some embodiments, the channel 60 is permanently attached to or positioned over or adjacent to the destination 50. In some embodiments in which the channel 60 is permanently attached to or positioned over or adjacent to the destination 50, the channel 60 is temporarily coupled to the receptacle 20 so that the apparatus 100 and the destination 50 may be decoupled.

In some embodiments, the channel 60 may be decoupled from the destination 50. In some embodiments in which the channel 60 may be decoupled from the destination 50, the channel 60 is permanently coupled to the receptacle 20.

In some embodiments, the channel 60 may be decoupled from both the receptacle 20 and the destination 50.

In some embodiments, the receptacle 20 is coupled to the panel 10 so that when the apparatus 100 is hung from or temporarily attached to the vertical surface of the shower or bathtub enclosure, the height of the first end 24 of the receptacle 20 is greater than the height of the second end 26 of the receptacle 20, thereby enabling the collected water to flow in the direction from the first end 24 of the receptacle 20, which may be open or closed, to the second end 26 of the receptacle 20. In some such embodiments, a channel 60 is coupled to the second end 26 of the receptacle 20, as shown in FIG. 8. In other embodiments, the apparatus 100 does not include the channel 60, and the collected water simply flows out of the second end 26 of the receptacle 20 and into a destination 50, as illustrated in the exemplary embodiment of FIG. 6.

Figure 9:
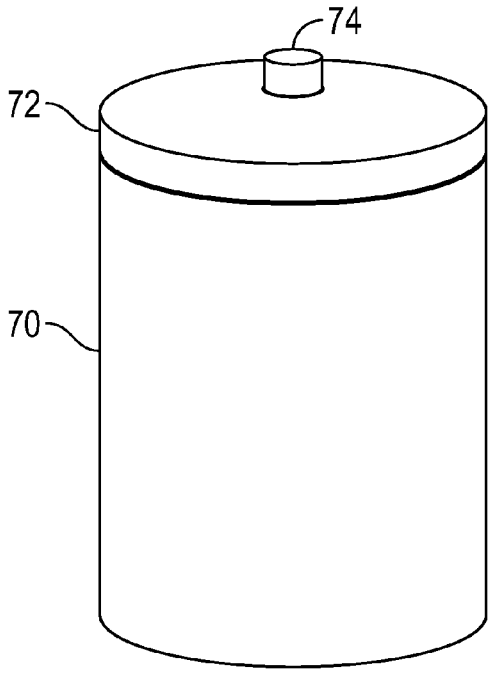
FIG. 9 illustrates a destination in the form of a container to which a water collection apparatus delivers collected water in accordance with some embodiments.

In some embodiments, the destination 50 is a container (e.g., a bucket). FIG. 9 illustrates an exemplary container 70 into which the apparatus 100 can deliver the collected water, either through a channel 60 or directly from the receptacle 20. The size of the container 70 may be selected based on one or more criteria. For example, the size of the container 70 may be selected so that a particular person or class of person (e.g., a child) is able to lift the container 70 when it is substantially full of collected water. As another example, the size of the container 70 may be selected so that the container 70 holds the maximum amount of water expected to be captured by the apparatus 100 during an average shower.

The container 70 may be made of any material suitable for holding the collected water. In some embodiments, the container 70 is made of a waterproof or water-resistant material. Examples of suitable materials include, but are not limited to, metal, wood, vinyl, rubber, plastic, cloth, canvas, polyester, urethane, polyethylene, or fiberglass.

The container 70 may have any appropriate shape. In some embodiments, the container 70 has a shape that allows the container 70 to be placed in the shower or bathtub enclosure in an unobtrusive way. For example, the container 70 may have a substantially cuboid shape to enable the container 70 to be placed in a corner of a shower stall. As another example, the container 70 may have a shape to allow the container 70 to be placed against the edge of a bathtub.

As illustrated in FIG. 9, in some embodiments, the container 70 includes a lid 72. In some embodiments in which the container 70 includes a lid 72, the channel 60 may be coupled to the lid 72 so that substantially all of the collected water flows into and remains within the container 70. The lid 72 may comprise a valve 74 that allows air to escape from the container 70 as the collected water fills the container 70. The valve 74 may be a one-way valve that allows the collected water to enter the container 70 and prevents leakage of water from the container 70 when the container 70 is full.

In some embodiments, the container 70 is transparent or translucent so that even if the lid 72 is in place, a user can observe the water level within the container 70 and thereby determine whether the container 70 needs to be emptied. In some embodiments, the container 70 includes a visual indicator (e.g., a gauge) that provides an indication of the volume of water inside the container 70.

In some embodiments, the user can couple the lid 72 to the container 70 after the collected water has flowed into the container 70 to facilitate moving the container 70 without spilling the collected water.

FIG. 10 illustrates an exemplary embodiment in which the apparatus 100 delivers water through a channel 60 to more than one destination 50 (i.e., to containers 70A and 70B). Although FIG. 10 illustrates a single channel 60 delivering the collected water to multiple destinations, it is to be appreciated that, as discussed elsewhere, multiple channels may be coupled to the receptacle 20 to deliver the collected water to multiple destinations. For example, if the first end 24 of the receptacle 20 is open, a second channel may be coupled to the first end 24 of the receptacle 20 to deliver collected water to a different destination than the destination to which the first channel delivers collected water.

Although many embodiments disclosed herein rely on gravity and/or water pressure to move the collected water from the receptacle 20 to the destination 50, thereby implying that the destination 50 is not positioned appreciably above the second end 26 of the receptacle 20, it is also possible to use a pump so that the destination 50 may be located at a higher elevation than the second end 26 of the receptacle. FIG. 11 illustrates an exemplary embodiment of the apparatus 100 in which the channel 60 is coupled to a pump 90, which pumps the collected water to the destination 50, which may be located at a higher elevation than the receptacle 20.

To use the apparatus 100 to collect water during a user's shower, the user disposes the apparatus 100 within a shower or bathtub enclosure (e.g., by affixing the apparatus 100 temporarily, semi-permanently, or permanently to a wall or door of the shower or bathtub enclosure) and, preferably, aims the showerhead so that at least some of the water from the showerhead that does not hit the user's body makes contact with the front surface of the panel 10 of the apparatus 100 and flows into the receptacle 20. In some embodiments, the user places a container 70 inside or outside of the shower or bathtub enclosure so that the container 70 collects the water flowing out of the receptacle 20. In some embodiments, the user couples a channel 60 to the receptacle 20, and optionally to the destination 50, so that the channel 60 may deliver the collected water to the destination 50.

To avoid obscuring the present disclosure unnecessarily, well-known prior-art components (e.g., pump 90) are shown in block diagram form and/or are not discussed in detail. Unless otherwise indicated herein, prior-art containers 70 may be adapted for use with the apparatus 100.

Furthermore, although the water collection apparatus 100 has been disclosed as being mounted inside of a shower or bathtub enclosure, the apparatus 100 may also be used in other environments, such as elsewhere indoors or outdoors to capture rainwater. For example, the apparatus 100 may be mounted, temporarily, semi-permanently, or permanently to or near a sink (e.g., a bathroom or kitchen sink), a rooftop, a shed, an outdoor wall, an outdoor window (e.g., on a house or a vehicle), or anywhere else where the apparatus 100 would be able to capture potable or non-potable water for use or reuse.

The drawings herein illustrate the apparatus 100 in its fully assembled form. It is to be appreciated that the apparatus 100 may be provided to users in a state that requires some assembly. For example, the user may need to attach the one or more connectors 30 to the panel 10. As another example, the user may need to attach the receptacle 20 to the panel 10. In embodiments in which a channel 60 delivers water to the destination 50, the user may need to couple the channel 60 to the receptacle 20 or to the destination 50 (or to both). Moreover, the apparatus 100 may include the destination 50 (e.g., a container of some sort), or the user may supply the destination 50. This disclosure specifically contemplates the apparatus 100 being provided to users in a fully assembled, partially assembled, or unassembled form, and the claims below are intended to include such embodiments.

Unless otherwise specifically defined herein, all terms are to be given their broadest possible interpretation including meanings implied from the specification and drawings, as well as meanings understood by those skilled in the art and/or as defined in dictionaries, treatises, etc. As used in the specification and the appended claims, the singular forms "a," "an," and "the" include plural referents unless otherwise specified. The word "or" is to be interpreted as inclusive unless otherwise specified. Thus, the phrase "A or B" is to be interpreted as meaning all of the following: "both A and B," "A but not B," and "B but not A." Any use of "and/or" herein does not mean that the word "or" alone connotes exclusivity.

The term "coupled" is used herein to express a direct connection as well as a connection through one or more intervening parts or structures. To the extent that the terms "include(s)," "having," "has," "with," and variants thereof are used in the detailed description or the claims, such terms are intended to be inclusive in a manner similar to the term "comprising." Also, the terms "exemplary" and "embodiment" are used to express examples, not preferences or requirements.

Although specific embodiments have been disclosed, it will be evident that various modifications and changes may be made thereto without departing from the broader spirit and scope of the disclosure. For example, features or aspects of any of the embodiments may be applied, at least where practicable, in combination with any other of the embodiments or in place of counterpart features or aspects thereof. Accordingly, the specification and drawings are to be regarded in an illustrative rather than a restrictive sense.

What is claimed is:

1. An apparatus for collecting water in a shower or bathtub enclosure, the apparatus comprising:

a panel comprising a water-resistant or waterproof material, wherein the panel is a separate apparatus that is not part of any wall, window, mirror, shower curtain, or door of the shower or bathtub enclosure;

one or more connectors coupled to or capable of being coupled to the panel, the one or more connectors enabling the panel to be removably attached to the shower or bathtub enclosure and disposed substantially vertically within the shower or bathtub enclosure;

a channel having a first end and a second end; and a receptacle directly attached to the panel by at least one fastener, the receptacle having (a) an opening adjacent to the panel to collect water directly from a surface of the panel, (b) a closed end to prevent the collected water from flowing out of the closed end, and (c) an open end to allow the collected water to flow out of the open end and into the channel, wherein the receptacle is configured to prevent the collected water from entering a drain within the shower or bathtub enclosure and to deliver the collected water through the channel to a destination other than through the drain within the shower or bathtub enclosure, wherein the first end of the channel is coupled to or capable of being coupled to the open end of the receptacle, and the second end of the channel is capable of being coupled to the destination.

2. The apparatus of claim 1, wherein the panel has a quadrilateral shape with a top edge and a bottom edge, and wherein the one or more connectors are coupled to or capable of being coupled to the panel closer to the top edge than to the bottom edge, and wherein the receptacle is directly attached to the panel closer to the bottom edge than to the top edge.

3. The apparatus of claim 2, wherein the quadrilateral shape is substantially rectangular.

4. The apparatus of claim 1, wherein the panel is flexible.

5. The apparatus of claim 4, wherein the water-resistant or waterproof material comprises vinyl.

6. The apparatus of claim 1, wherein the water-resistant or waterproof material comprises metal, wood, vinyl, rubber, plastic, cloth, canvas, polyester, urethane, polyethylene, or fiberglass.

7. The apparatus of claim 1, wherein the one or more connectors comprise one or more suction cups or one or more hooks.

8. The apparatus of claim 1, wherein the receptacle comprises a pipe.

9. The apparatus of claim 1, further comprising the destination, and wherein the destination comprises a container.

10. The apparatus of claim 1, wherein the channel comprises a hose.

11. The apparatus of claim 10, wherein the hose is a food-grade hose.

12. The apparatus of claim 1, wherein at least a portion of the channel is flexible.

13. The apparatus of claim 1, further comprising the destination, and wherein the destination is a container comprising a lid with a valve to enable air to escape from the container as the collected water fills the container.

14. The apparatus of claim 13, wherein the valve is a one-way valve configured to allow the collected water to enter the container and to prevent leakage of water from the container when the container is full.

15. The apparatus of claim 1, wherein the destination is a first destination, and wherein the second end of the channel is further capable of being coupled to a second destination.

16. The apparatus of claim 1, wherein the destination is a first destination, and wherein the receptacle comprises a valve having a first position and a second position, the first position for directing the collected water to the first destination, and the second position for directing the collected water to a second destination.

17. The apparatus of claim 1, wherein the receptacle comprises a valve having a first position and a second position, the first position to allow the collected water to flow to the destination and the second position to prevent the collected water from flowing to the destination.

18. The apparatus of claim 1, further comprising a pump coupled to or capable of being coupled to the receptacle and capable of being coupled to the destination, the pump for pumping the collected water to the destination.

19. The apparatus of claim 1, wherein the receptacle is rigid.

20. The apparatus of claim 1, wherein the at least one fastener comprises a rivet, screw, pin, bolt, rod, stud, anchor, staple, hook, wire, adhesive, suction cup, snap, hook, hook-and-eye fastener, or nail.

* * * * *